US007429042B2

(12) United States Patent
Ban et al.

(10) Patent No.: US 7,429,042 B2
(45) Date of Patent: Sep. 30, 2008

(54) NIP ROLLER FORCE ADJUSTMENT MECHANISM

(75) Inventors: Romulus A. Ban, Oakville (CA); Robert H. Brown, Hamilton (CA); David Bognar, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 441 days.

(21) Appl. No.: 11/214,169

(22) Filed: Aug. 29, 2005

(65) Prior Publication Data

US 2007/0045944 A1 Mar. 1, 2007

(51) Int. Cl.
*B65H 5/06* (2006.01)

(52) U.S. Cl. ..... 271/274; 271/272; 271/273

(58) Field of Classification Search ..... 271/272, 271/273, 274

See application file for complete search history.

(56) References Cited

U.S. PATENT DOCUMENTS 4,638,991 A * 1/1987 Kato ..... 271/272
5,511,774 A * 4/1996 Lyga ..... 271/273
5,947,470 A * 9/1999 Fernandez ..... 271/272
6,595,512 B2 7/2003 de Koning et al.
6,857,631 B2 2/2005 Morrison et al.
6,910,686 B2 6/2005 Awano

FOREIGN PATENT DOCUMENTS

JP 05132192 A * 5/1993

* cited by examiner

*Primary Examiner*—Kaitlin S Joerger
(74) *Attorney, Agent, or Firm*—Maginot, Moore & Beck LLP

(57) ABSTRACT

An apparatus for conveying a substrate or sheet through a printing machine comprises a drive roller and a baffle assembly forming a path for the substrate past the drive roller. The baffle assembly includes an idler roller having an axle rotatably supported within the baffle assembly to cooperate with the drive roller to exert a nip force on the substrate. A nip spring connected to the baffle assembly bears against a bushing carrying the idler roller axle to exert a nip force on the idler roller. A nip force adjustment apparatus is mounted within the baffle assembly and is operable to apply an adjustment force on the bushing of the idler roller to augment the nip force generated by the nip spring. The adjustment apparatus includes an actuator movable between a neutral position and an activated position, a force transmission element movably supported within the baffle assembly to engage, in an operable position, the bushing of the idler roller to exert the adjustment force, and a linkage connecting the actuator to the force transmission element to move the force transmission element into the operable position when the actuator is moved from the neutral position to the activated position.

23 Claims, 8 Drawing Sheets

NIP ROLLER FORCE ADJUSTMENT MECHANISM

TECHNICAL FIELD

The present disclosure is directed to media handling systems, such as systems for feeding, transporting and/or finishing sheets passing through a printing machine.

BACKGROUND

In printing machines, such as printers, copiers, facsimile machines, multi-function machines and the like, a substrate is conveyed through various stations of the apparatus. For instance, in a digital copier, the substrate or sheet bearing the image to be copied may be mechanically conveyed across a platen in proximity to an imaging apparatus. In addition, sheets may be mechanically extracted from a supply and fed through image transfer stations and finishing stations in the digital copier. One exemplary machine is depicted schematically in FIG. 1. This machine 10, which may be a primary print processing device or a finishing station, directs the substrate received through an inlet chute into a processing station 12. The finished substrate exits the machine through an outlet chute 15 into a collection element 17, for instance.

In many such machines the substrate may pass along multiple paths that are generally defined by chutes and baffles, such as the baffle assembly 14 shown in FIG. 1. The substrate is typically propelled along these paths by nip roller assemblies, such as the nip rollers 20 and 21, which include a driven roller and one or more idler rollers that "pinch" or "nip" the sheet therebetween. The nip roller assemblies are situated at pre-determined intervals along each substrate path, with the intervals generally corresponding to the smallest size sheet being fed through the path. While the idler rollers do not drive the sheet directly, they are important in providing the nip force normal to the direction of travel of the sheet to ensure non-slip feeding or transport of the sheet and to help ensure that the substrate travels straight along the path without skewing or translating laterally. These functions of the idler roller are particularly accentuated in a long transport path where accumulated alignment errors may cause jams, or may require expensive re-registration stations to re-align the sheet within the path.

It is necessary that the idler rollers be freely rotatable as well as slightly vertically movable to accommodate different substrate thicknesses passing through the nip roll. This vertical degree of freedom is also necessary to account for variable deformations of the drive roller or to adjust for wear of the nip roller components. One known system for allowing the idler roller to vertically "float" is depicted in FIG. 2. The Substrate passes between a drive roller D and an idler roller I. The axle A of the idler roller I is supported within a slot formed in a frame M. In this known system, a one or more extension springs E supported by the frame M straddles a bushing supporting the axle A of the idler roller and exert a downward force on the roller.

While this system may be acceptable for many nip rollers in a transport path, in some machines variable nip force is required. For example, in some finishing machines a sheet is initially allowed to slip through the nip roller assembly in one direction (which may be accomplished by using a nip force significantly lower than that of the downstream nip), but a high nip force is required to drive the sheet in a reverse direction. This approach is commonly used to buckle the trailing end of the sheet for the purpose of registering the trailing edge against a backstop. Certain prior systems rely upon the spring, such as the extension spring E, or a torsion spring, to provide the necessary force. However, in these approaches, the spring rates are usually very high in order to apply a sufficiently large force for a small deflection of the spring. As a result, the applied force is widely variable and difficult to control. Ultimately, this prior approach requires very tight tolerances for the components of the nip roller assembly.

SUMMARY

According to aspects disclosed herein, there is provided an apparatus for conveying a substrate or sheet through a printing machine that comprises a drive roller and a baffle assembly forming a path for the substrate past the drive roller. The baffle assembly includes an idler roller having an axle rotatably supported within the baffle assembly to cooperate with the drive roller to exert a nip force on the substrate. A nip spring connected to the baffle assembly bears against a bushing carrying the idler roller axle to exert a nip force on the idler roller. A nip force adjustment apparatus is mounted within the baffle assembly and is operable to apply an adjustment force on the bushing of the idler roller to augment the nip force generated by the nip spring. The adjustment apparatus includes an actuator movable between a neutral position and an activated position, a force transmission element movably supported within the baffle assembly to engage, in an operable position, the bushing of the idler roller to exert the adjustment force, and a linkage connecting the actuator to the force transmission element to move the force transmission element into the operable position when the actuator is moved from the neutral position to the activated position.

According to further aspects, a nip force adjustment apparatus is provided that is operable to apply a force to a nip roller assembly for conveying a substrate. The adjustment apparatus may comprise an actuator movable between a neutral position and an activated position and an adjustment lever pivotably supported relative to the nip roller assembly. The adjustment lever carries a force transmission element to engage the nip roller assembly in an operable position to exert a force thereon. A linkage is provided for connecting the actuator to the adjustment lever to pivot the adjustment lever relative to the nip roller assembly to move the force transmission element into the operable position when the actuator is moved from the neutral position to the activated position.

One disclosed feature of the embodiments is a nip roller assembly for conveying a substrate within a machine which comprises a drive roller and an idler roller rotatably supported relative to the drive roller to exert a nip force on the substrate conveyed therebetween. The idler roller has an axle with a bushing mounted thereon. A support structure within the machine rotatably supports the axle while a nip spring connected to the support structure is configured to bear against the bushing to exert a nip force on the idler roller toward the drive roller. The assembly is further provided with a nip force adjustment apparatus that is operable to apply an adjustment force on the idler roller to augment the nip force generated by the nip spring. The adjustment apparatus may include an actuator movable between a neutral position and an activated position, a force transmission element movably supported on the support structure to engage, in an operable position, the bushing of the idler roller to exert the adjustment force; and a linkage connecting the actuator to the force transmission element to move the force transmission element into the operable position when the actuator is moved from the neutral position to the activated position.

DESCRIPTION OF THE EMBODIMENTS

Figure 1:
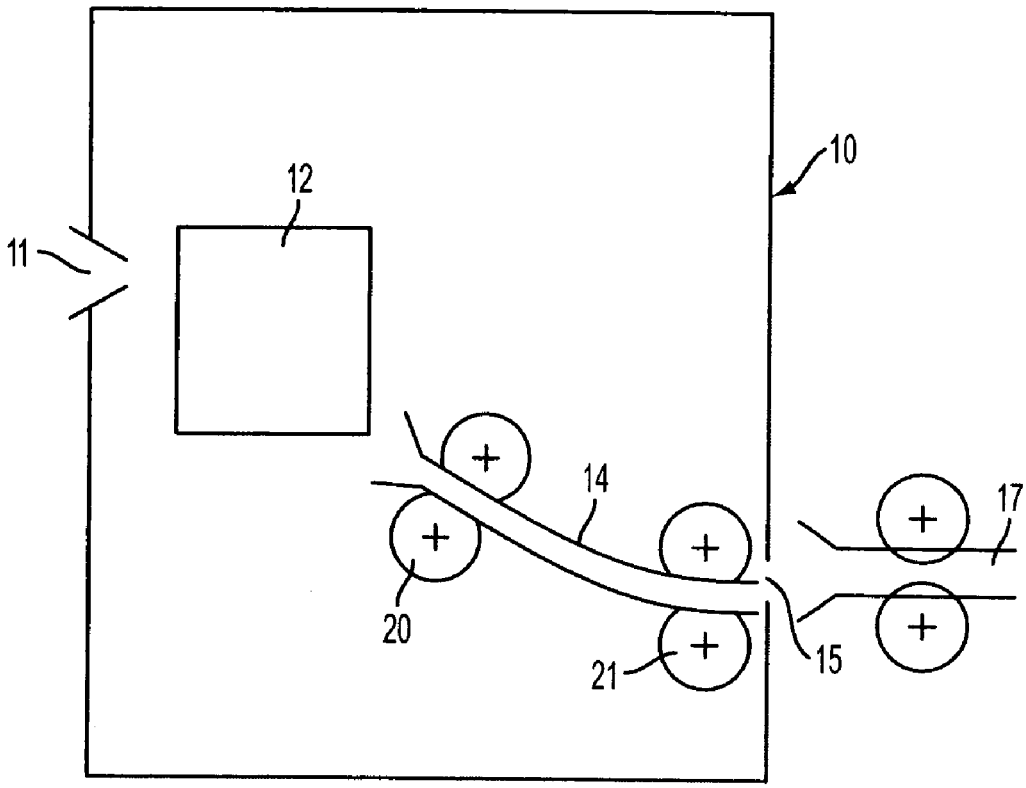
FIG. 1 is a schematic representation of a printing apparatus which may incorporate the disclosed embodiments.
Figure 2:
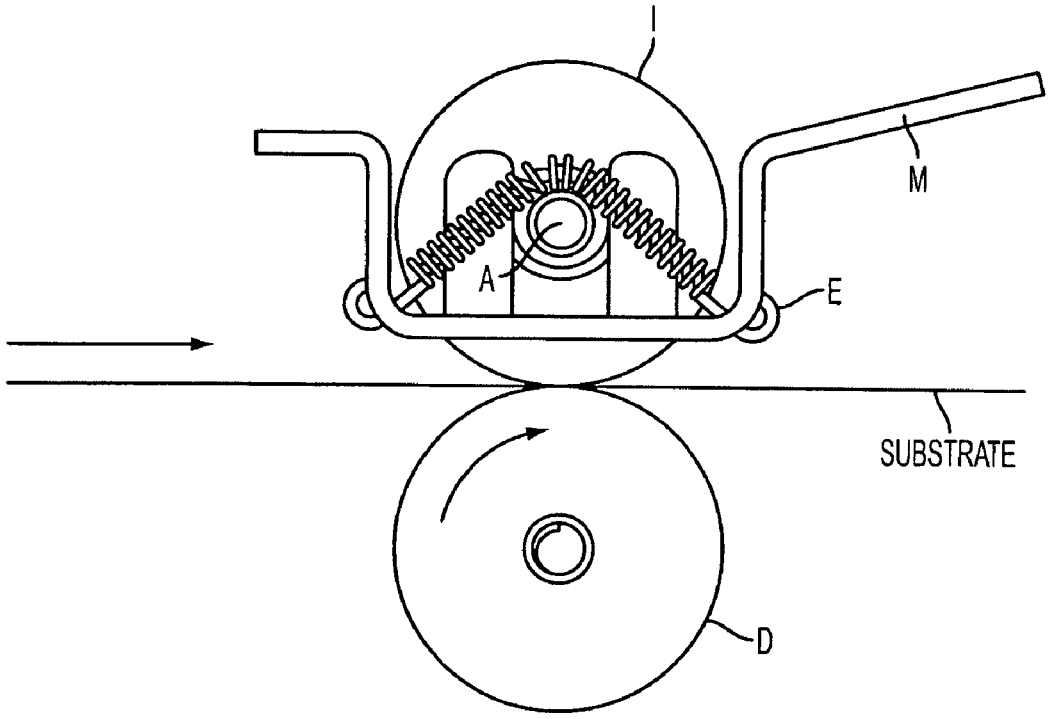
FIG. 2 PRIOR ART
FIG. 2 is a side view of a nip roller assembly of the prior art.
Figure 3:
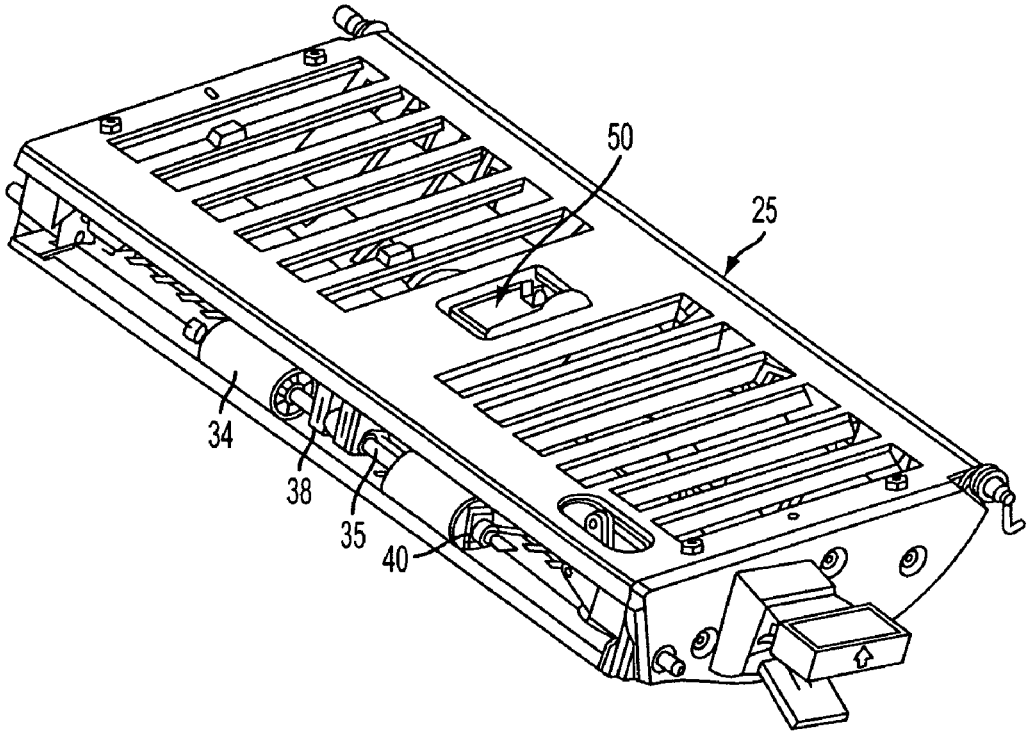
FIG. 3 is a top perspective view of a baffle assembly configured to incorporate the disclosed embodiments.

According to one embodiment, a force adjustment assembly 50 is mounted within a baffle 25. The baffle 25 may replace the baffle 14 in the generic machine 10 illustrate din FIG. 1. As shown in more detail in FIG. 4, the baffle assembly 25 includes a body 26, the outer surface of which forms part of the chute through which the substrate or paper sheet passes. The body is closed by a baffle cover 27. Idler rollers 30 are situated at the baffle exit 28 and biased toward the substrate by nip springs 32. The rollers 30 are preferably disposed in the center of the paper path and may or may not be associated with a driven roller on the opposite side of the path.

A leading idler roller 34 is disposed at the entrance 33 to the baffle assembly. Preferably, the roller 34 includes a pair of rollers mounted on a common axle 35. A nip spring 36 connects the axle 35 to the baffle body 26 by way of a pair of spring mounts 38. More particularly, the nip spring 36 bears against a bushing 37 that rotatably supports the axle 35. The ends of the axle 35 are contained within retainers 40 so that the rollers are exposed through roller openings 42 and so that the roller 34 may move vertically against the force of the nip spring 36. The baffle body 26 includes a mounting plate 45 for supporting the adjustment assembly 50 so that the assembly may engage the leading idler roller 34 as described herein.

Figure 5:
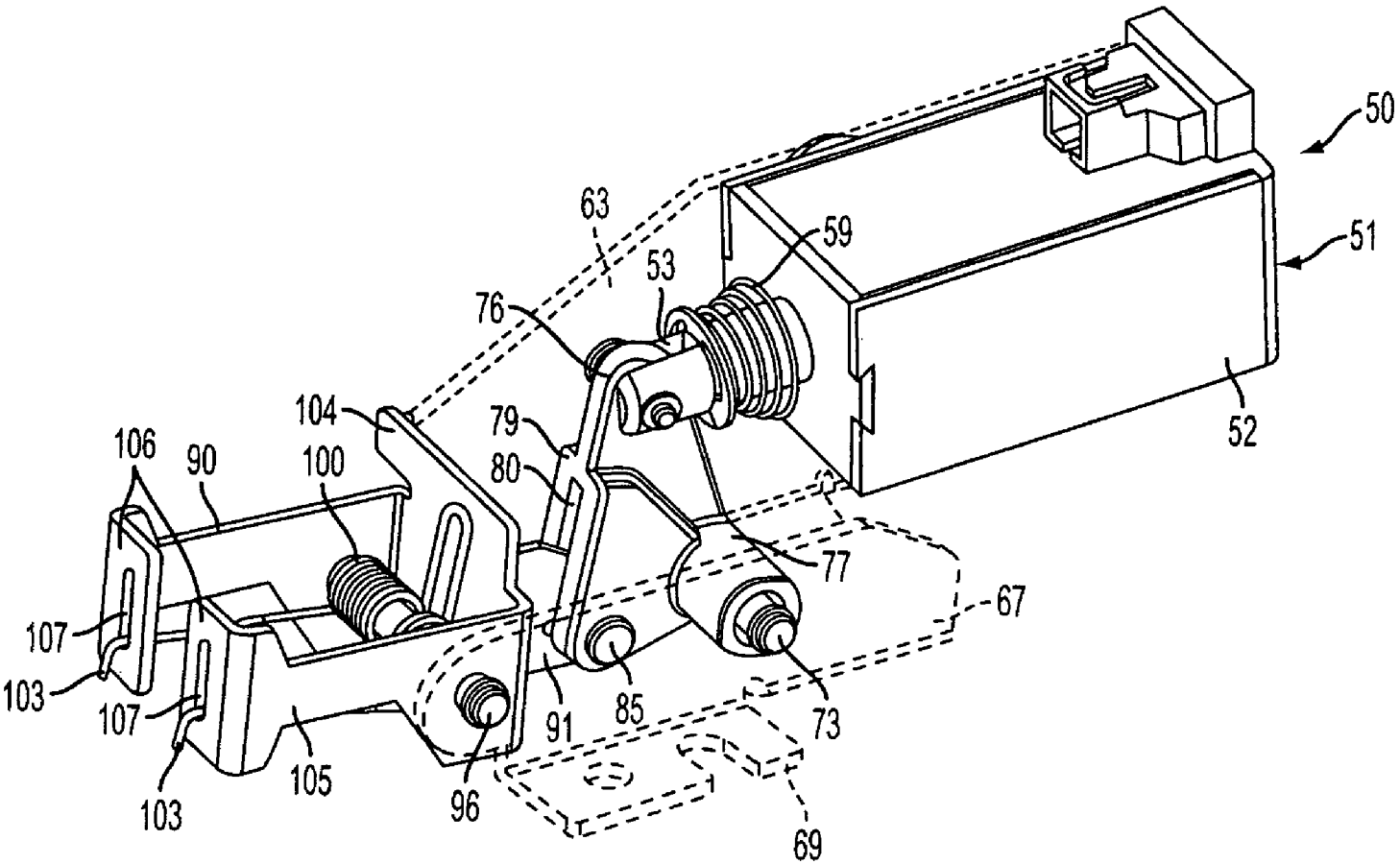
FIG. 5 is a side perspective view of one embodiment of a nip force adjustment assembly.
Figure 6:
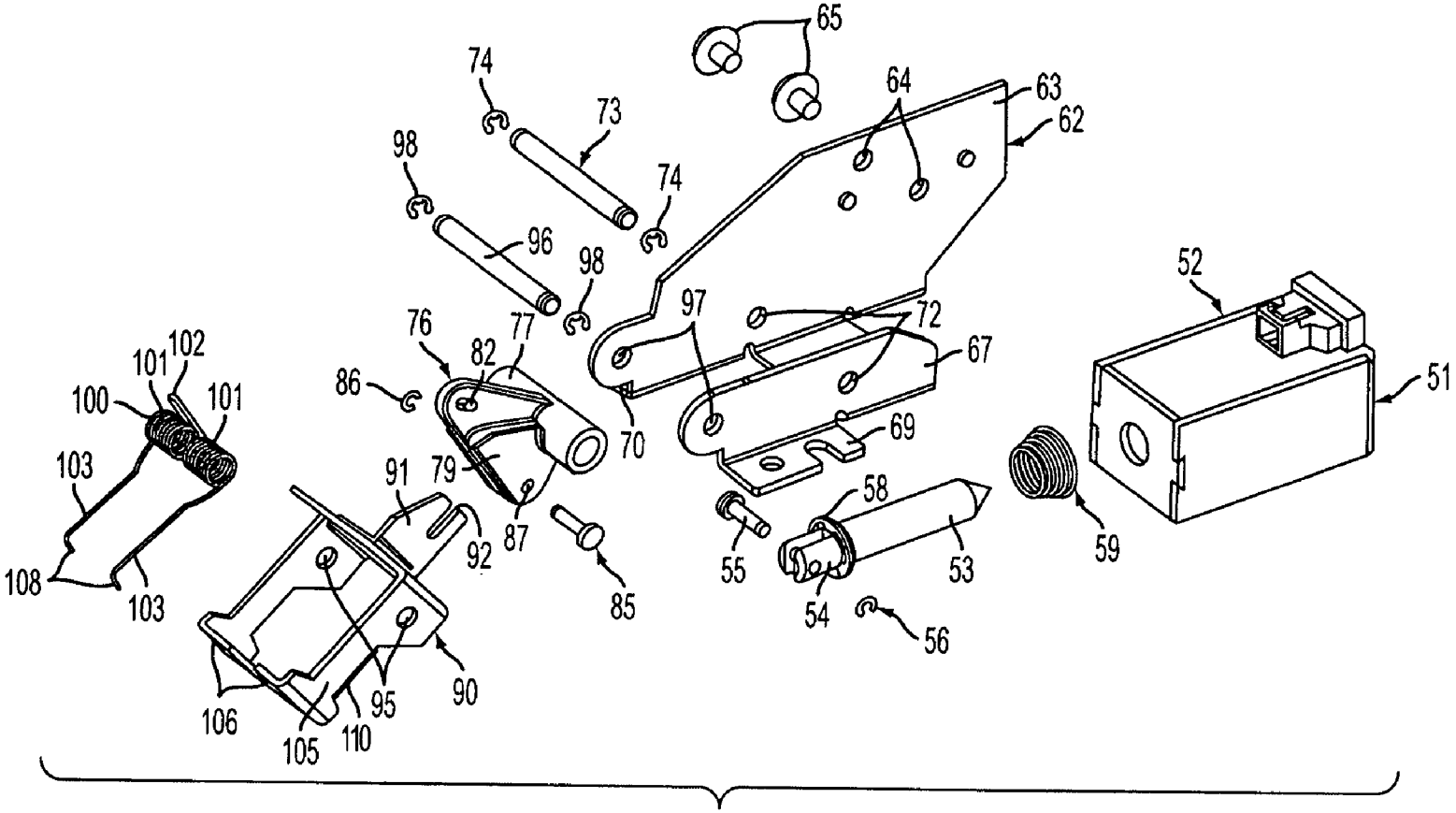
FIG. 6 is a perspective exploded view of the nip force adjustment assembly shown in FIG. 5.
Figure 7:
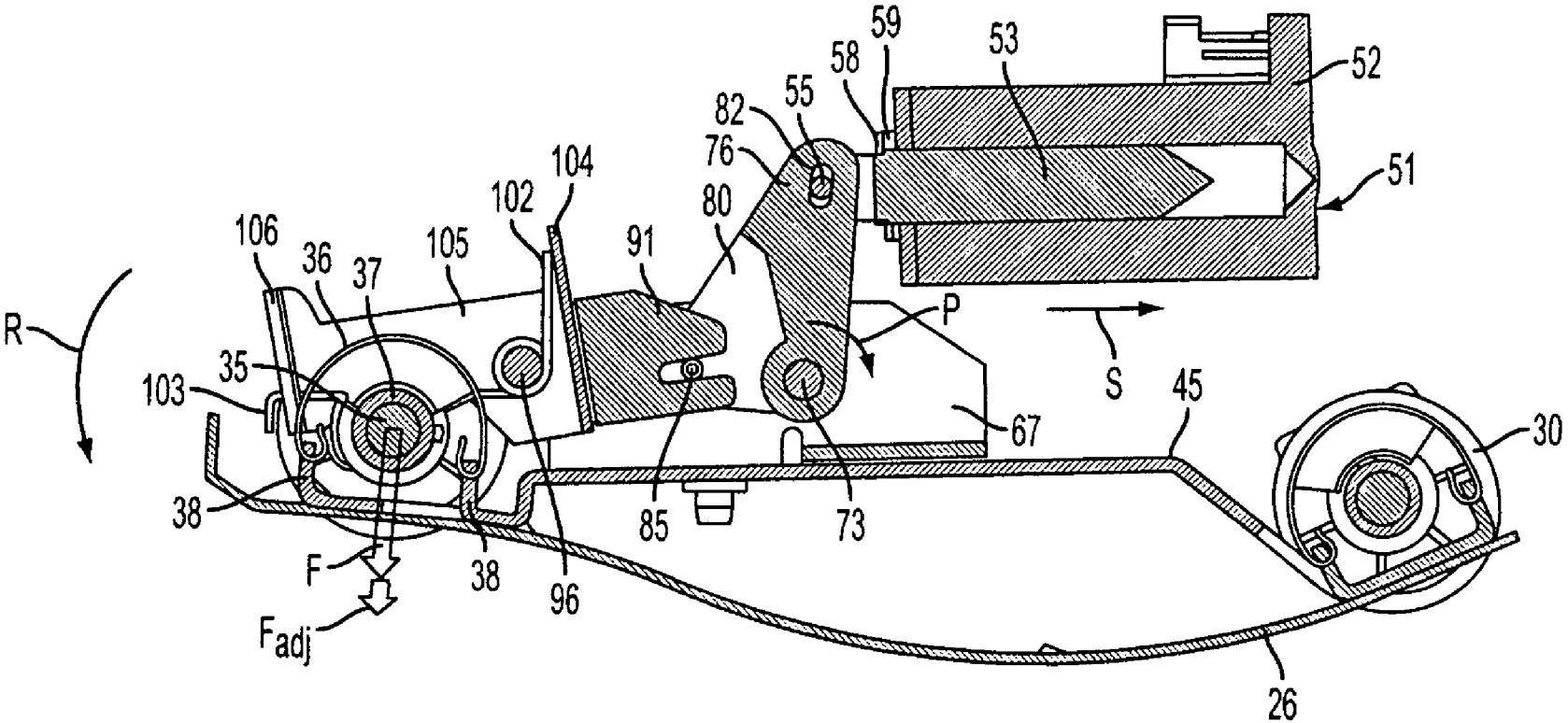
FIG. 7 is a side view of the nip force adjustment assembly shown in FIG. 5-6, depicted in its activated position.

Referring to FIGS. 5-7, the elements of the adjustment assembly 50 are illustrated. The assembly includes an actuator 51, which in the illustrated embodiment includes a solenoid 52 with an associated plunger 53. In one embodiment, the solenoid 52 is an "on-off" electromagnetic solenoid in which the plunger 53 is extended in the "off" position and retracted when the solenoid 52 is activated to the "on" position. In other words, as shown in FIG. 7 the plunger moves in the direction S when the solenoid 52 is activated.

The plunger 53 terminates in a clevis end 54 (FIG. 6) with a pin 55 passing through openings in the clevis end and retained by a retaining ring 56. The clevis end 54 is configured to mate with an intermediate lever 76. In particular, the intermediate lever defines an elongated opening 82 through which the clevis pin 56 extends to connect the intermediate lever to the plunger in a manner that permits relative rotation between the two components about the pin 55.

The plunger is provided with a shoulder 58 adjacent the clevis end 54. The shoulder 58 is operable to trap a return spring 59 between the body of the solenoid 52 and the end of the plunger. The return spring 59 operates to push the plunger 53 to its "off" or extended position, as shown in FIGS. 5 and 7, when the solenoid is deactivated. In the illustrated embodiment, the return spring 59 is a conical spring so that its compressed height is minimal.

The adjustment assembly 50 includes a support bracket 62 that is configured to be mounted to the mounting plate 45 of the baffle assembly 25. The support bracket 62 includes a solenoid mounting plate 63 that defines a number of screw holes to accept screws 65 used to mount the solenoid 52 to the plate 63. The support bracket 62 also includes a pivot plate 67 that is offset from the mounting plate 63 and that cooperates with the mounting plate to pivotably support other components of the adjustment assembly 50, as described herein. The two plates include corresponding mounting flanges 69 and 70 that are preferably configured for screw mounting to the mounting plate 45 of the baffle assembly.

The solenoid mounting plate 63 and the pivot plate 67 define aligned openings 72 for receiving a lever axle 73. The lever axle is retained within the openings by retaining rings 74 engaged at the opposite ends of the axle 73. The axle is configured to extend through a pivot bushing 77 of the intermediate lever 76 so that the intermediate lever 76 may pivot about the axle 73. In particular, the intermediate lever 76 is configured to pivot in the direction of the arrow P in FIG. 7 when the solenoid 52 is activated to retract the plunger 53 in the direction of the arrow S. Alternatively, when the solenoid is deactivated and the return spring 59 pushes the plunger in the opposite direction, the intermediate lever also pivots in the opposite direction about the axle 73. The elongated aspect of the opening 82 allows the clevis pin 55 to translate slightly as the plunger 53 is stroked to allow the plunger to maintain its linear motion. Alternatively, though not optimally, the solenoid may be supported on the bracket 62 to allow the solenoid itself to pivot to maintain the plunger in axial alignment as the plunger is stroked and the intermediate lever pivots.

Figure 4:
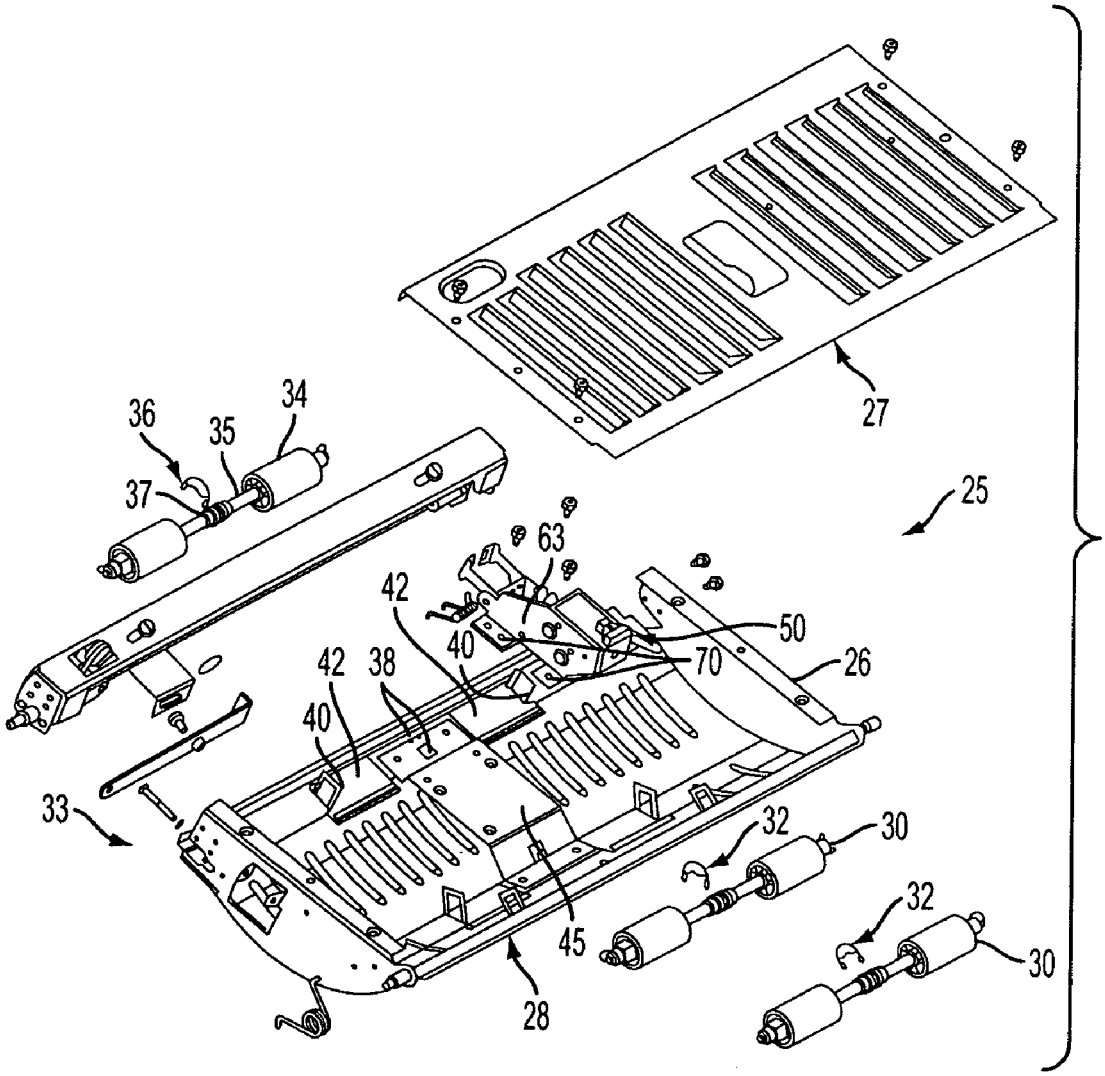
FIG. 4 is a perspective exploded view of the baffle assembly shown in FIG. 3.

The intermediate lever 76 includes a lever arm 79 that is integral with the bushing 77. The lever arm 79 defines a slot 80 (FIG. 5) so that the arm takes the form of a clevis. A force transmitting pin 85 passes through openings 87 to traverse the end of the slot 80. A retaining ring 86 holds the pin 85 within the opening while allowing the pin to rotate as necessary. The pin 85 is configured to be disposed within a pin slot 92 in the tongue 91 of a nip force adjustment lever 90. The adjustment lever 90 includes a pair of lever arms 105 connected by a back plate 104 (FIG. 5). The ends of the lever arms 105 are bent inward to form end flanges 106, so that the adjustment lever 90 is in the form of a block letter C. The adjustment lever is particularly configured to straddle the nip spring 36 in a position above the bushing 37 for the axle 35 of the leading idler roller 34, as shown in FIGS. 4 and 7.

The lever arms 105 define pivot openings 95 adjacent the back plate 104. The openings are configured to receive a pivot axle 96 that extends between openings 97 defined in the solenoid mounting plate 63 and the pivot plate 67 of the support bracket 62. As with the other axles, the axle 96 is held in place by retaining rings 98 that allow the axle to rotate within the openings 95, 97 as necessary. It can be appreciated that the adjustment lever 90 is thus supported on the bracket 62 so that the lever 90 can pivot about the axle 96. With the adjustment lever pivotably supported, the force transmitting pin 85 is engaged within the open pin slot 92 in the tongue 91 of the lever 90. Referring to FIG. 7, it can be seen that when the intermediate lever 76 pivots in the direction of the arrow P, the force transmitting pin 85 also pivots upward, thereby also forcing the tongue 91 of the adjustment lever 90 upward. This movement results in a downward pivoting of the adjustment lever 90 in the direction of the arrow R.

The adjustment lever 90 is configured to carry a double torsion spring 100, with the pivot axle 96 passing through the coils 101 of the spring, as shown in FIG. 5. The two coils 101 are connected by an anchor 102 that bears against the back plate 104 of the lever 90. A reaction arm 103 extends from each of the coils 101. The spring arms 103 are positioned to extend through slots 107 in the end flanges 106 of the lever so that the arms are free to translate vertically within the slots. The ends 108 of the spring arms 103 may be bent to help retain the arms within the slots 107. The double coil torsion spring 100 is loaded within the adjustment lever 90 in a pre-tensioned state—i.e., with the anchor 102 bearing against the back plate 104 and the reaction arms bearing against the lower end of the spring arm slots 107. Thus, in this pre-tensioned state, the arms 103 of the spring are arranged to bear directly against the bushing 37 of the axle 35 of the idler roller 34, as shown in FIG. 7, and to exert an increasing spring force as the idler roller translates upward toward the adjustment lever 90. The lever arms 105 define cut-outs or notches 110 which provide an upper limit on the vertical movement of the roller axle.

It should be understood that the leading idler roller 34 is retained by the interaction of the ends of the axle 35 with the corresponding axle retainers 40. Moreover, the nip spring 36 restrains the idler roller in the vertical direction by imparting a downward spring force F (FIG. 7) against the axle of the roller. In many applications, this spring force F is sufficient for proper operation of the idler roller assembly (such as the roller assembly 21 in FIG. 1). However, as explained above, certain machines require the application of variable or greater force to the nip roller assembly. The adjustment assembly 50 provides this additional force by activation of the solenoid 52.

Figure 8:
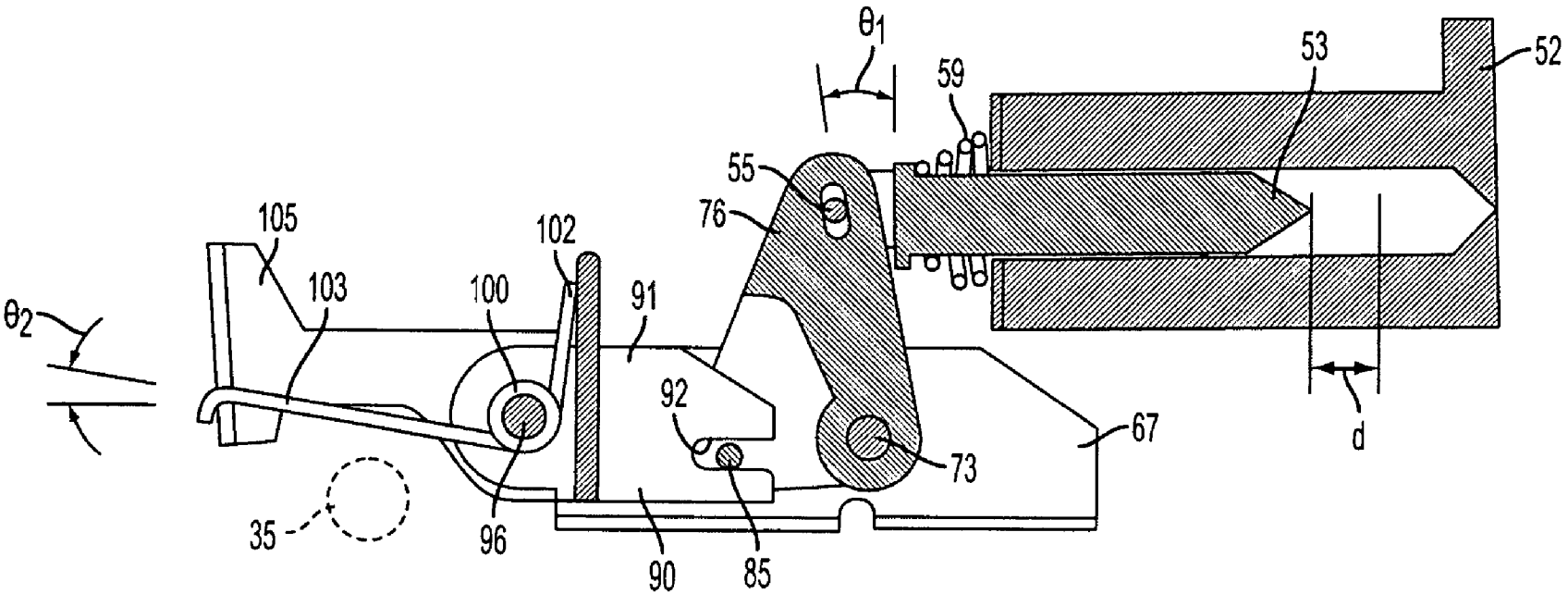
FIG. 8 is a side view of the nip force adjustment assembly shown in FIG. 5-6, depicted in its neutral or de-activated position.

In one embodiment, in the neutral position (or de-activated position) of the adjustment assembly 50, shown in FIG. 8, the spring arms 103 are offset from the bushing 37 of the idler roller axle 35 so that the double coil torsion spring does not exert any downward force on the leading idler roller 34. As shown in FIG. 8, in the neutral position, the plunger is extended from the solenoid 52 under the influence of the return spring 59. With the plunger in this neutral position, the intermediate lever 76 and adjustment lever 90 are pivoted so that the lever arms 105 are pivoted away from the bushing 37.

When the solenoid is activated, the plunger is drawn into the solenoid a distance d, as shown in FIG. 8. This movement of the plunger causes the intermediate lever 76 to pivot in the direction P (FIG. 7) through an angle $\theta_1$ (FIG. 8). This pivoting in turn causes the pin 85 to pivot the adjustment lever 90 in the direction R (FIG. 7) through an angle $\theta_2$. This movement of the adjustment lever 90 brings the torsion spring 100 into contact with the axle bushing 37 and deflects the torsion spring 100 by a pre-determined amount to push downward with a pre-determined adjustment force $F_{adj}$, as shown in FIG. 7. This adjustment force $F_{adj}$ is in addition to the force F applied to the roller axle by the nip spring 36.

Control of the solenoid 52 may be integrated into the machine control system. In many machines, such as digital copiers, a microprocessor integrates user commands with various substrate, environment and operation sensors to control the components of the machine. The microprocessor may be modified to issue control commands to the solenoid 52 in relation to the machine operation.

In the illustrated embodiment, the angular movement of the adjustment lever 90, angle $\theta_2$, is less than the angular movement of the intermediate lever 76, angle $\theta_1$, because the distance between force transmission pin 85 and the pivot axle 96 (the pivot point for the adjustment lever) is greater than the distance between the pin 85 and the pivot axle 73 (the pivot point for the intermediate lever). This aspect of the adjustment assembly 50 may be modified to adjust the tolerance of the apparatus based on the movement of the plunger 53. In other words, the relationship between the angular movements of the two levers may be adjusted to account for greater or lesser travel of the plunger. Moreover, the relative angular movements may be modified so that a large plunger translation in direction S correlates to a small angular movement $\theta_2$ of the adjustment lever and torsion spring. With this approach, only a slight pivoting of the adjustment lever is necessary to bring the torsion spring into operative engagement with the bushing 37 supporting the idler roller axle. Any error in the stroke of the plunger (i.e., any deviation from the anticipated travel distance d) is reduced to a minimal error in the angular movement of the lever 90 and torsion spring, which ultimately leads to only a minimal error in the adjustment force $F_{adj}$ added to the nip spring force F.

On the other hand, an acceptable tolerance for the adjustment force $F_{adj}$ allows for a larger tolerance upstream from the torsion spring 100, which means that the upstream components of the adjustment assembly 50 may be manufactured to larger tolerances. The ability of the torsion spring arms 103 to move within the slots 107 in the adjustment lever 90 absorbs over-pivoting of the adjustment lever 90, which allows for an even larger tolerance on the actuation side of the assembly operation.

This aspect of the adjustment assembly also allows the use of a smaller spring rate spring 100 than in prior art nip roller assemblies. Since the adjustment assembly 50 generates a nip force $F_{adj}$ that augments the force of the existing nip spring 36, the torsion spring 100 that gives rise to that adjustment force $F_{adj}$ need not be large enough to generate the total nip force.

In accordance with the above embodiment, the nip force adjustment assembly 50 is either essentially a two-position apparatus. In the neutral position, the solenoid 52 is de-activated, the plunger 53 is held in its neutral position by conical spring 59 and the levers 76, 90 are situated so that the torsion spring reaction arms 103 are offset from bushing 37 for the roller axle 35, as shown in FIG. 8. When the solenoid is activated, the plunger is drawn fully into the solenoid, the conical spring is fully depressed and the two levers pivot through their corresponding angles $\theta_2$ and $\theta_2$, which thus pivots the spring arms 103 into contact with the axle bushing 37. While this two-position function may be produced by an electromagnetic solenoid 52 and plunger 53, other comparable two-position actuators are contemplated. For instance, the actuator 51 may be a pneumatic cylinder that is supplied by an existing blower in the particular machine. As a further alternative, the actuator 51 may be arranged to "pull", rather than "push" the intermediate lever 76 from its neutral to its actuated position.

In yet another modification, the adjustment assembly may be capable of step-wise adjustment of the nip force. In this alternative, the actuator 51 may be configured for step-wise movement, rather than two-position activation. The plunger may thus be movable in pre-defined increments to adjust the amount of pivoting of the torsion spring reaction legs 103 against the bushing 37 for the idler roller axle 35. Greater pivoting of the adjustment lever 95 causes greater deflection of the torsion spring 100, which increases the spring force $F_{adj}$ exerted on the roller axle 35. By way of example, one form of step-wise actuator may substitute a stepper motor with a pinion gear for the solenoid 52 and a rack gear that mates with the pinion gear for the plunger 53.

The actuator 51 in the illustrated embodiment is a linear actuator. Alternatively, a rotary actuator may be implemented in which the pin 55 is mounted offset on a rotating disc, for instance. The rotating disc may be directly driven by a rotary motor or indirectly driven by an offset drive linear actuator. Space limitations within the particular machine may dictate the form of the actuator 51 driving the intermediate lever 76.

In the illustrated embodiment, the nip force adjustment assembly 50 is shown integrated into a baffle assembly 25. It is understood that the assembly 50 may integrated into other locations within a printing machine where nip rollers are utilized.

The above embodiments incorporate a double torsion spring 100 into the adjustment assembly 50. Other elastic or resilient force transmission elements or spring elements may be carried by the adjustment lever 90. For example, a single torsion spring may be utilized, as well as a pair of separate torsion springs bearing on opposite ends of the bushing 37. In another alternative, a spring plate or leaf spring may be mounted between the back plate 104 and the end flanges 106 of the adjustment lever 90. The plate may be cantilevered so that the free end of the plate can bend upward as the plate bears against the idler roller bushing, or may be configured to bend or buckle in its middle portion. In a further modification, the adjustment lever 90 may carry a linear spring element supported in alignment with the bushing 37 of the idler roller 34.

The nip force adjustment assembly 50 incorporates a linkage between the actuator 51 and the adjustment lever 90 that carries the double torsion spring 100 or comparable elastic or resilient force transmission element. In the illustrated embodiment, this linkage includes the clevis end 54 and pin 55, the intermediate lever 76, the force transmitting pin 85 and the tongue 91 of the adjustment lever 90. Other forms of the linkage are contemplated that translate the movement of the actuator 51 into pivoting of the adjustment lever 90. For instance, in certain embodiments, the actuator may operate directly on the adjustment lever to pivot the lever as the actuator moves from its neutral to its activated position. It can be appreciated that a shorter linkage may increase the tolerance for the adjustment force $F_{adj}$ or may be limited by the space available in a particular application.

It will be appreciated that various of the above-disclosed features, as well as other features and functions, or alternatives thereof, of the disclosed embodiments may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A nip force adjustment apparatus operable to apply a force to a nip roller assembly for conveying a substrate, comprising:

an actuator movable between a neutral position and an activated position;

an adjustment lever pivotably supported relative to the nip roller assembly, said adjustment lever carrying a double coil torsion spring having a pair of reaction arms arranged to engage the nip roller assembly in an operable position to exert a force thereon; and a linkage connecting said actuator to said adjustment lever to pivot said adjustment lever relative to the nip roller assembly to move said double coil torsion spring into said operable position when said actuator is moved from said neutral position to said activated position.

2. The nip force adjustment apparatus of claim 1, wherein said actuator is a solenoid having a plunger connected to said linkage, said solenoid operable to move said plunger between said neutral position and said activated position.

3. The nip force adjustment apparatus of claim 2, wherein said actuator includes a return spring operable to return said plunger to said neutral position from said activated position.

4. The nip force adjustment apparatus of claim 1, wherein said linkage includes an intermediate lever pivotably supported relative to the nip roller assembly, said intermediate lever coupled between said actuator and said adjustment lever to translate movement of said actuator into pivoting of said adjustment lever.

5. A nip force adjustment apparatus operable to apply a force to a nip roller assembly for conveying a substrate, comprising:

an actuator movable between a neutral position and an activated position;

an adjustment lever having a tongue defining a slot, the adjustment lever being pivotably supported relative to the nip roller assembly, said adjustment lever carrying a force transmission element to engage the nip roller assembly in an operable position to exert a force thereon; and a linkage connecting said actuator to said adjustment lever to translate movement of said actuator into pivoting of said adjustment lever, said linkage includes an intermediate lever, the intermediate lever being pivotably supported relative to the nip roller assembly said intermediate lever having a force transmission pin disposed within said slot and arranged to bear against said slot to pivot said adjustment lever relative to the nip roller assembly to move said force transmission element into said operable position when said intermediate lever is pivoted by said actuator as said actuator is moved from said neutral position to said activated position.

6. The nip force adjustment apparatus of claim 4, wherein:

said actuator is a solenoid having a plunger, said solenoid operable to move said plunger between said neutral position and said activated position, said plunger defining a clevis end with a clevis pin passing therethrough; and said intermediate lever defines a clevis pin slot for receiving said clevis pin with said intermediate lever within said clevis end, said clevis pin slot arranged so that movement of said clevis pin with said plunger pivots said intermediate lever.

7. The nip force adjustment apparatus of claim 4, further comprising a support bracket to be fixed relative to the nip roller assembly, said support bracket configured to pivotably support said adjustment lever and said intermediate lever offset from each other.

8. A nip force adjustment apparatus operable to apply a force to a nip roller assembly for conveying a substrate, comprising:

an actuator movable between a neutral position and an activated position;

an adjustment lever that includes a pivot axle, and a tongue defining a slot, said adjustment lever carrying a force transmission element to engage the nip roller assembly in an operable position to exert a force thereon;

a linkage including an intermediate lever having an intermediate pivot axle, and a force transmission pin disposed within said slot, said slot and said force transmission pin being disposed between said pivot axle and said intermediate pivot axle the intermediate lever connecting said actuator to said adjustment lever to pivot said adjustment lever relative to the nip roller assembly to move said force transmission element into said operable position when said actuator is moved from said neutral position to said activated position; and a support bracket fixed relative to the nip roller assembly, said support bracket configured to pivotably support said adjustment lever and said intermediate lever offset from each other.

9. The nip force adjustment apparatus of claim 1, wherein:

said adjustment lever includes a pivot axle pivotably supported relative to the nip roller assembly, a back plate and an end flange;

said torsion spring having a pair of coils disposed on said pivot axle, an anchor portion restrained by said back plate and said reaction arms restrained by said end flange.

10. The nip force adjustment apparatus of claim 1, further comprising a support bracket to be fixed relative to the nip roller assembly, said support bracket including a portion pivotably supporting said adjustment lever.

11. A nip roller assembly for conveying a substrate within a machine comprising:

a drive roller;

an idler roller rotatably supported relative to said drive roller to exert a nip force on a substrate conveyed between said drive roller and said idler roller, said idler roller having an axle with a bushing mounted thereon;

a support structure within the machine for rotatably supporting said axle of said idler roller;

a nip spring connected to said support structure and bearing against said bushing to exert a nip force on said idler roller toward said drive roller; and a nip force adjustment apparatus operable to apply an adjustment force on said idler roller to augment the nip force generated by said nip spring, said adjustment apparatus including;

an actuator movable between a neutral position and an activated position;

a double coil torsion spring having a pair of reaction arms arranged to engage, in an operable position, said bushing of said idler roller to exert said adjustment force; and a linkage connecting said actuator to said double coil torsion spring to move said double coil torsion spring into said operable position when said actuator is moved from said neutral position to said activated position.

12. The nip roller assembly according to claim 11, wherein said actuator is a solenoid having a plunger connected to said linkage, said solenoid operable to move said plunger between said neutral position and said activated position.

13. The nip force adjustment apparatus of claim 11, wherein said linkage includes:

an adjustment lever pivotably supported on said support structure and configured to carry said double coil torsion spring said adjustment lever pivotable to move said double coil torsion spring into said operable position; and an intermediate lever pivotably supported on said support structure, said intermediate lever coupled between said actuator and said adjustment lever to translate movement of said actuator into pivoting of said adjustment lever.

14. A nip roller assembly for conveying a substrate within a machine comprising:

a drive roller;

an idler roller rotatably supported relative to said drive roller to exert a nip force on a substrate conveyed between said drive roller and said idler roller, said idler roller having an axle with a bushing mounted thereon;

a support structure within the machine for rotatably supporting said axle of said idle roller;

a nip spring connected to said support structure and bearing against said bushing to exert a nip force on said idler roller toward said drive roller; and a nip force adjustment apparatus operable to apply an adjustment force on said idler roller to augment the nip force generated by said nip spring, said adjustment apparatus including:

an actuator movable between a neutral position and an activated position;

a force transmission element movably supported on said support structure to engage, in an operable position, said bushing of said idler roller to exert said adjustment force; and a linkage having an adjustment lever that includes a tongue defining a slot, and an intermediate lever having a force transmission pin disposed within said slot and arranged to bear against said slot, both of the adjustment lever and the intermediate lever being pivotably supported on said support structure, the adjustment lever being configured to carry said force transmission element and move said force transmission element into said operable position, and said intermediate lever being coupled between said actuator and said adjustment lever to pivot said adjustment lever when said intermediate lever is pivoted by said actuator being moved from said neutral position to said activated position.

15. The nip force adjustment apparatus of claim 13, wherein: said plunger defining a clevis end with a clevis pin passing therethrough; and said intermediate lever defines a clevis pin slot for receiving said clevis pin with said intermediate lever within said clevis end, said clevis pin slot arranged so that movement of said clevis pin with said plunger pivots said intermediate lever.

16. The nip force adjustment apparatus of claim 15, further comprising a support bracket mounted on said support structure, said support bracket configured to pivotably support said adjustment lever and said intermediate lever offset from each other.

17. A nip roller assembly for conveying a substrate within a machine comprising:

a drive roller;

an idler roller rotatably supported relative to said drive roller to exert a nip force on a substrate conveyed between said drive roller and said idler roller, said idler roller having an axle with a bushing mounted thereon;

a support structure within the machine for rotatably supporting said axle of said idler roller, said support structure including a support bracket mounted on said support structure;

a nip spring connected to said support structure and bearing against said bushing to exert a nip force on said idler roller toward said drive roller; and a nip force adjustment apparatus operable to apply an adjustment force on said idler roller to augment the nip force generated by said nip spring, said adjustment apparatus including:

a solenoid having a plunger with a clevis end and a clevis pin passing therethrough, said solenoid operable to move said plunger between a neutral position and an activated position;

a force transmission element movably supported on said support structure to engage, in an operable position, said bushing of said idler roller to exert said adjustment force;

an adjustment lever having a pivot axle supported on said supped bracket, and a tongue defining a slot; and an intermediate lever having an intermediate pivot axle supported on said support bracket, and a force transmission pin disposed within said slot, said slot and said force transmission pin being disposed between said pivot axle and said intermediate pivot axle to couple said actuator to said adjustment lever to translate movement of said actuator into pivoting of said adjustment lever, said adjustment lever and said intermediate lever being pivotably supported by said support bracket offset from each other.

18. The nip force adjustment apparatus of claim 11, wherein:

said adjustment lever includes a pivot axle pivotably on said support structure, a back plate and an end flange;

said double coil torsion spring having a pair of coils disposed on said pivot axle, an anchor portion being restrained by said back plate and said reaction arms being restrained by said end flange.

19. A method for controlling the nip force between a drive roller and an idler roller of a nip roller assembly for conveying a substrate comprising:

applying a first force to the idler roller to generate a nip force between the drive roller and the idler roller; and selectively moving a two-position actuator from a neutral position to an activated position to apply a second force to the idler roller to augment the nip force.

20. The method for controlling the nip force of claim 19, wherein the first and second forces are applied to a bushing of the idler roller.

21. The method for controlling the nip force of claim 19, wherein the first and second forces are generated by a spring.

22. The method for controlling the nip force of claim 21, wherein:

the first force is generated by a nip spring restraining the bushing of the idler roller; and the second force is generated by a torsion spring carried by a movable element, the element movable so that a reaction arm of the torsion spring is selectively brought into force transmitting contact with the bushing of the idler roller.

23. An apparatus for conveying a substrate through a printing machine comprising:

a drive roller;

a baffle assembly forming a path for the substrate past the drive roller, said baffle assembly including;

an idler roller having an axle rotatably supported within said baffle assembly to cooperate with said drive roller to exert a nip force on the substrate conveyed between said drive roller and said idler roller, said idler roller further including a bushing mounted on said axle;

a nip spring connected to said baffle assembly and bearing against said bushing to exert a nip force on said idler roller toward said drive roller; and a nip force adjustment apparatus operable to apply an adjustment force on said idler roller to augment the nip force generated by said nip spring, said adjustment apparatus including;

an actuator movable between a neutral position and an activated position;

a double coil torsion spring having a pair of reaction arms arranged to engage, in an operable position, said bushing of said idler roller to exert said adjustment force; and a linkage connecting said actuator to said double coil torsion spring to move said double coil torsion spring into said operable position when said actuator is moved from said neutral position to said activated position.

* * * * *